US006305330B1

(12) United States Patent
Darling

(10) Patent No.: US 6,305,330 B1
(45) Date of Patent: Oct. 23, 2001

(54) CIRCULATING FLUIDIZED BED COMBUSTION SYSTEM INCLUDING A HEAT EXCHANGE CHAMBER BETWEEN A SEPARATING SECTION AND A FURNACE SECTION

(75) Inventor: Scott Darling, Annandale, NJ (US)

(73) Assignee: Foster Wheeler Corporation, Clinton, NJ (US)

( * ) Notice: Subject to any disclaimer, the term of this patent is extended or adjusted under 35 U.S.C. 154(b) by 0 days.

(21) Appl. No.: 09/517,743

(22) Filed: Mar. 3, 2000

(51) Int. Cl.[7] ..... F22B 37/24

(52) U.S. Cl. ..... 122/4 D; 110/245; 165/104.16; 122/510

(58) Field of Search ..... 122/4 D, 360, 122/493, 496, 510; 110/245; 432/58; 165/104.16

(56) References Cited

U.S. PATENT DOCUMENTS 3,927,646 * 12/1975 Dungey et al. ..... 122/6 A
4,332,218 * 6/1982 Stewart et al. ..... 122/4 D
4,641,608 * 2/1987 Waryasz ..... 122/4 D
4,665,864 * 5/1987 Seshamani et al. ..... 122/4 D
4,704,992 * 11/1987 Waryasz ..... 122/4 D
5,911,201 * 6/1999 Eickenberg ..... 122/4 D
6,039,008 * 3/2000 Anderson et al. ..... 122/4 D

* cited by examiner

*Primary Examiner*—Gregory Wilson
(74) *Attorney, Agent, or Firm*—Fitzpatrick, Cella, Harper & Scinto

(57) ABSTRACT

A top-supported circulating fluidized bed boiler system includes a furnace, having sidewalls of a tube wall construction, for combusting fuel and producing combustion products, a particle separator, connected to the furnace, for separating particles from the combustion products from the furnace, an external, preferably non-cooled, heat exchange chamber connected to the particle separator for removing heat from the combustion products, a return duct, connected to the heat exchange chamber, for returning particles separated by the separator to the furnace, a rigid support construction for supporting elements of the system, and a suspension arrangement for suspending the heat exchange chamber from the rigid support construction. The suspension arrangement includes, for preferably 60% or more of its length, at least one of steam tubes and water tubes at a temperature of about 300 to about 550° C.

19 Claims, 4 Drawing Sheets

CIRCULATING FLUIDIZED BED COMBUSTION SYSTEM INCLUDING A HEAT EXCHANGE CHAMBER BETWEEN A SEPARATING SECTION AND A FURNACE SECTION

BACKGROUND OF THE INVENTION

The present invention relates to a circulating fluidized bed combustion system and a heat exchange chamber utilized therein, and, more particularly, to a system in which the heat exchange chamber is provided between a separating section and a furnace section of the circulating fluidized bed combustion system.

Fluidized bed combustion systems are well known and include a furnace section in which air is passed through a bed of particulate material to fluidize the bed and to promote combustion of fuel in the bed at a relatively low temperature. The bed may include fossil fuel, such as coal, sand and a sorbent for the sulfur oxides generated as a result of the combustion of the coal. These types of combustion systems are often used in steam generators in which water is passed in a heat exchange relation with the fluidized bed to generate steam and permit high combustion efficiency and fuel flexibility, high sulfur adsorption and low nitrogen emissions.

In circulating fluidized bed systems, the fluidizing air velocity is such that the gases passing through the bed entrain a substantial amount of the fine particulate solids. External solids recycling is achieved by disposing a particle separator, usually a cyclone separator, at the furnace outlet to receive the flue gases, and the solids entrained therewith, from the fluidized bed. The solids are separated from the flue gases and the flue gases are passed to a heat recovery section while the solids are recycled back to the furnace. This recycling extends the fuel retention and improves the efficiency of utilization of a sulfur adsorbent, thus reducing consumption of both the adsorbent and fuel.

Circulating fluidized beds are characterized by relatively intensive internal and external solids recycling, which makes them insensitive to fuel heat release patterns, thus minimizing temperature variations and stabilizing sulfur emissions at a low level. When fluidized bed systems are used to generate steam, the heat released in the exothermal reactions taking place in the furnace may be recovered by heat exchange surfaces disposed in several locations in the system. The walls of the furnace section are usually so-called tube walls, made by welding tubes together with fins. A heat transferring fluid, usually water or steam, is led through the tube walls in order to cool the furnace walls, and to transfer heat therefrom. Other heat exchange surfaces may be located within the system, such as in the walls of a cooled cyclone, in the heat recovery section downstream of the cyclone or in a separate heat exchange chamber, which may be in flow connection with the internal or external recycling of the solids.

The furnace section and the cyclone separator may be bottom-supported, the structure being rigidly supported at its bottom, and the main thermal expansion taking place upwards from the bottom. When designing a large bottom-supported unit, the mechanical loads on the tube walls have to be well considered as the whole weight of the furnace section is transferred through the walls to the lower parts of the boiler, with the tube walls in compressive stress. A significant share of the load may need to be carried from the top steel structure via constant load springs, which may increase the costs significantly.

Therefore, it is, especially in large units, conventional to construct a top-supported furnace and cyclone, i.e., to support them on a steel structure constructed on and above the system, with the main thermal expansion taking place downwards. A top-supported unit is generally easier to assemble than a bottom-supported unit. In top-supported systems, the furnace walls do not have to be stiffened due to the weight of the boiler, because the tube walls can easily endure the tensile stress caused by the load.

The most typical way of manufacturing a heat exchange chamber is to make it of steel plates, which are thermally isolated and protected against wear by a relatively thick layer of refractory material. Such enclosures are cost-effective to construct but, due to different thermal expansions, difficult to join to other units of the system constructed of tube walls. To solve this problem, one has to use flexible joints, such as metal or fabric baffles to accommodate the relative motions between the different parts of the system. Such baffles, however, are expensive and prone to wear.

It is a common practice to construct an external heat exchange chamber as a bottom-supported structure. If the furnace section and the cyclone separator of the system are bottom-supported as well, the relative motions between the different units may be relatively small and the joints therebetween do not have to accommodate large motions. As the heat exchange chamber is typically located near the ground, it is also common, in larger units, to construct the heat exchange chamber as being bottom-supported, while the furnace section and the cyclone separator are top-supported. In such a construction, the relative thermal motions may be very large, and special expansion joints are required to accommodate the motions between the cyclone and the heat exchange chamber and between the heat exchange chamber and the furnace. Typically, these expansion joints are very expensive metal joints.

Another method of constructing a heat exchange chamber is to make its enclosure as a cooled tube wall structure. U.S. Pat. No. 5,911,201 describes a suspending unit comprising a cooled heat exchange chamber integrated with a cyclone separator. U.S. Pat. No. 5,425,412 discloses a method of making a furnace, a cyclone and a heat exchange chamber of tube walls and to integrate them all closely together. In such a system, the temperatures of these units are very close to each other, and thus, due to similar materials and constructions, their thermal expansions are very much alike, and no flexible joints are needed between the units. A drawback in such cooled heat exchange chambers, however, is that the construction, especially if it includes complicated structures and cooled inlet and outlet connections, requires a lot of manual bending and welding of the tubes, and is thus time-consuming and expensive to manufacture. Also, in some applications, the heat exchange chambers tightly integrated with the furnace may take too much space around the lower part of the furnace. This is especially the case in large units, where very high total heat exchange capacity, and, e.g., many fuel feeding ducts, as well, are required in the lower part of the furnace.

SUMMARY OF THE INVENTION

It is an object of the present invention to provide a fluidized bed combustion system and a heat exchange chamber utilized therein in which the above-mentioned problems are minimized or overcome.

It is a more specific object of the present invention to provide a fluidized bed combustion system, and a heat exchange chamber utilized therein, which is cost-effective to construct.

Especially, it is an object of the present invention to provide a fluidized bed combustion system and a heat exchange chamber utilized therein in which the costs of the flexible joints in the connections to the heat exchange chamber are minimized.

It is a still further object of the present invention to provide a compact fluidized bed combustion system and a heat exchange chamber utilized therein in which a lot of free space is provided around the lower part of the combustion chamber to be used, e.g., for feeding in various materials.

Towards the fulfillment of these and other objects, the present invention provides a top-supported fluidized bed boiler system comprising a furnace, having sidewalls of a tube wall construction, for combusting fuel and producing combustion products, a particle separator, connected to the furnace, for separating particles from the combustion products from the furnace, an external heat exchange chamber connected to the particle separator for removing heat from the combustion products, a return duct, connected to the heat exchange chamber, for returning particles separated by the separator to the furnace, a rigid support construction for supporting elements of said system, and suspension means, comprising at least one of steam tubes and water tubes, for suspending said heat exchange chamber from said rigid support construction.

The heat exchange chamber may be a simple chamber or a unit which includes several chambers, valves, etc. The supporting hot steam or water tubes, which, when the boiler is in operation, contain water or steam near or above the boiling temperature of water at high pressure, are thus at a temperature of about 300 to about 550° C. Therefore, the hot steam or water tubes have a similar thermal expansion to that of the furnace. Suspending the heat exchange unit by suspension means comprising hot steam or water tubes, instead of supporting it on the ground or hanging it by rigid, cool hanger rods, significantly reduces the relative thermal motions between the furnace and the thermal exchange unit.

A large fluidized bed boiler may be several tens of meters high, and thus, the thermal motions may be on the order of a tenth of a meter. As an example, a 30 m long steel wall, steel having a thermal expansion coefficient of $12\times10^{-6}$/° C., lengthens in a temperature change of 300° C. by about 11 cm. Thus, if the upper parts of a furnace separator and a heat exchange chamber located 30 m lower are fixed, the duct from the heat exchange chamber to the lower part of the furnace needs a flexible joint which is able to lengthen vertically by more than 11 cm.

According to the present invention, the suspension means of the heat exchanger unit mainly comprises hot steam or water tubes, and thus, the required elasticity of the ducts leading to the heat exchange chamber is clearly less than that in the previous example. According to a preferred embodiment of the present invention, the heat exchange unit is suspended from a steel structure above the boiler system, and more than 60%, more preferably even more than 80%, of the length of the suspension means of the heat exchange unit includes hot steam or water tubes.

The particle recycling section of a fluidized bed boiler typically comprises a separator section having a cylindrical upper part, a conical lower part and a return duct connected to a heat exchange chamber. The separator section, or at least the upper part of it, can be made as a cooled tube wall construction. Typically, the horizontal cross section of the heat exchange chamber is about as large as that of the upper part of the particle separator. In such a system, the heat exchange chamber may, according to a preferred embodiment of the present invention, be arranged below the separator section in such a way that the suspension means of the heat exchange chamber includes hanger means which is connected to a cooled upper part of the particle separator.

According to another preferred embodiment of the present invention, the suspension means of a heat exchange unit includes hanger means, which comprises hot water or steam tubes and short rigid hanger rods. Such cooled hanger means is preferably arranged between the heat exchange unit and the upper part of a particle separator. According to a preferred embodiment, at least 50%, and even more preferably at least 70%, of the length of the hanger means between the upper part of the particle separator and the heat exchange unit is made of hot water or steam tubes. The hot water or steam tubes between the upper part of the particle separator and the heat exchange unit may be, e.g., steam or water supply lines or extensions of the cooling tubes in the upper part of the particle separator.

According to an advanced construction, described in, e.g., U.S. Pat. No. 5,281,398, the particle separator may have a rectangular upper part and a non-symmetrical lower part, where the sidewall of the separator closest to the furnace section extends nearly vertically all the way down to the lower part of the return duct. The manufacturing and maintenance of such a separator is very cost-effective, and it can be connected to the furnace in a compact way. In a preferred embodiment of the present invention, which is especially applicable to non-symmetrical particle separators, as described above, a heat exchange chamber is suspended by hanger means, a part of which is connected to the return duct or to the lower part of the particle separator and another part to the upper section of the particle separator.

Preferably, in the above-mentioned embodiment, the part of the hanger means connected to the upper part of the separator comprises hot water or steam tubes and short rigid hanger rods. Correspondingly, the part of the hanger means connected to the return duct or to the lower part of the particle separator preferably comprises short rigid hanger rods connected to an extended horizontal inlet header feeding hot water or steam to vertical tubes of a cooled return duct or of the lower part of the particle separator.

Particles are usually conducted from the heat exchange unit back to the lower part of the furnace via a duct having a flexible joint. Because the heat exchange unit, suspended according to the present invention, more or less follows the thermal motions of the furnace, the flexible joint in the duct between the heat exchange unit and the furnace also does not have to endure very large motions, and a joint with a moderate flexibility is sufficient.

Compared to the heat exchange unit disclosed in U.S. Pat. No. 5,425,412, the present construction also provides a compact solution, but does not require as much space at the lower part of the furnace. Thus, there is a lot of room for various connections for feeding, e.g., fuel, bed material, sorbent and secondary air to the bed.

The main idea of the present invention is that the suspension of the heat exchange unit is not at a constant temperature, but instead, mainly consists of hot water or steam tubes, which approximately follow the temperature of the tube walls of the boiler system. This construction significantly reduces the relative motions between the heat exchange unit and the rest of the boiler system. Thus, large-motion expansion joints are not needed. The reduced motions will also reduce the costs of the expansion joints, and allow the use of fabric baffles rather than very expensive metal baffles.

BRIEF DESCRIPTION OF THE DRAWINGS

The above brief description, as well as further objects, features and advantages of the present invention will be more fully appreciated by reference to the following detailed description of the presently preferred, but nonetheless illustrative, embodiments in accordance with the present invention, when taken in conjunction with the accompanying drawings wherein.

DESCRIPTION OF THE PREFERRED EMBODIMENTS

Figure 1:
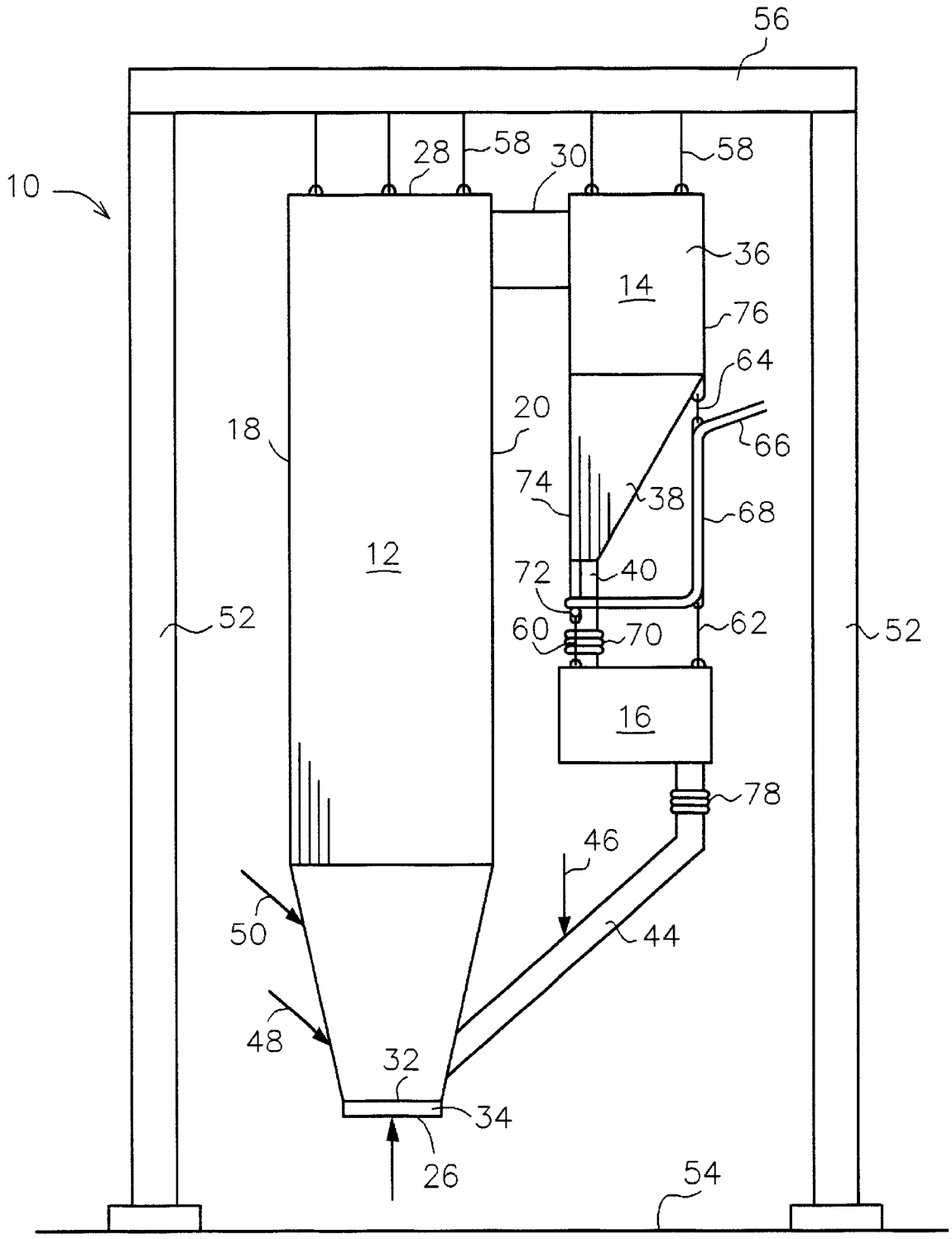
FIG. 1 is a schematic elevational view of a fluidized bed combustion system according to a first exemplary embodiment of the present invention.
Figure 2:
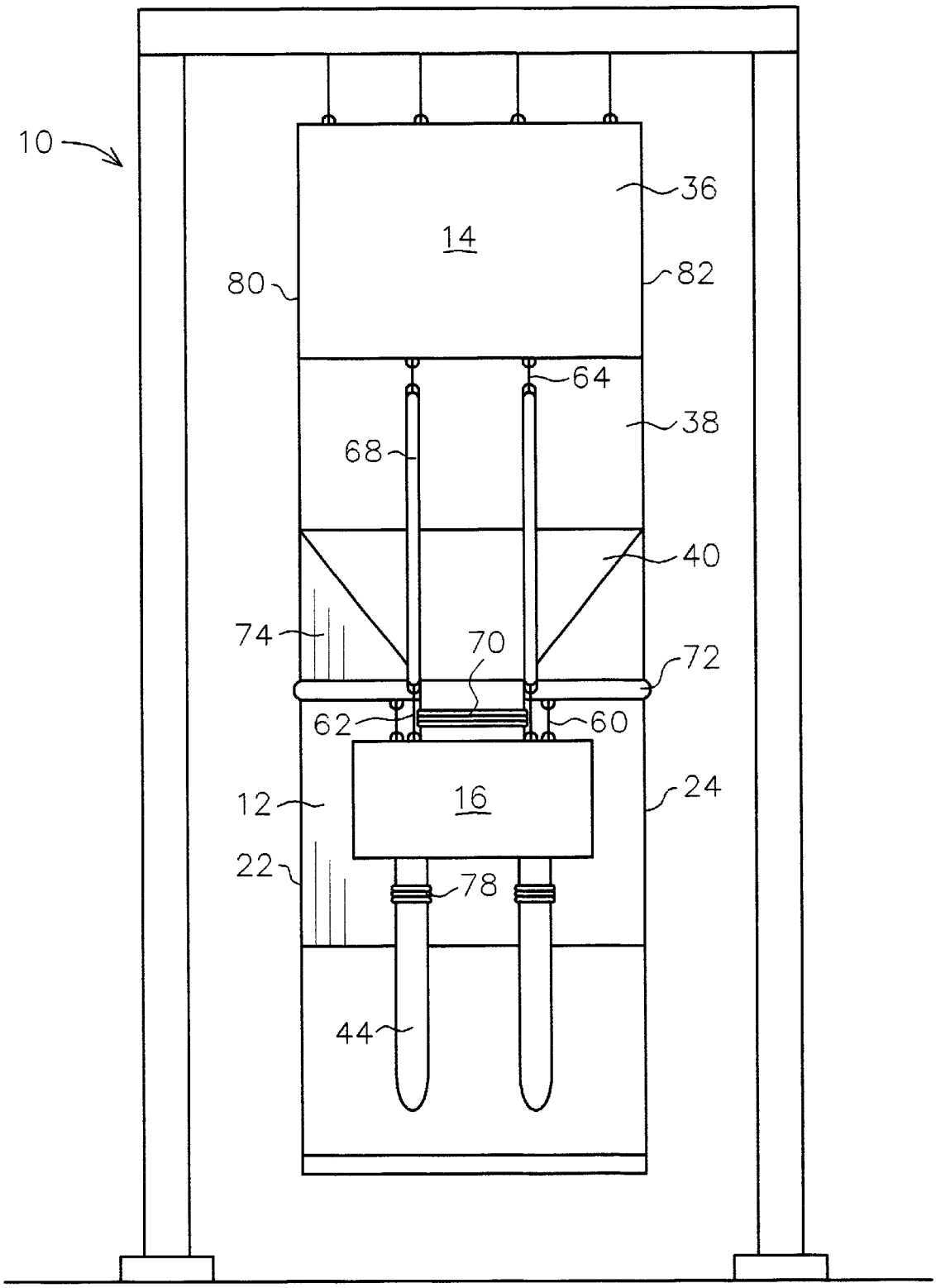
FIG. 2 is another schematic elevational view of a fluidized bed combustion system according to the first embodiment of the present invention.

FIGS. 1 and 2 depict a fluidized bed combustion system 10 according to a preferred embodiment of the present invention. The combustion system 10 is used for the generation of steam and includes a furnace section 12, a separating section 14 (such as a cyclone separator) and a heat exchange chamber 16. The furnace section 12 includes an upright water-cooled enclosure, having a front wall 18, a rear wall 20, two sidewalls 22 and 24, a floor 26 and a roof 28.

A conduit 30 is provided in the upper portion of the furnace section 12 for permitting combustion flue gases produced in the furnace section 12 to pass from the furnace section 12 into the separating section 14. It is understood that proper ducting (not shown) is provided to permit the separated gases to pass from the top of the separating section 14 to a heat recovery section, dust separator and stack (not shown).

The walls 18, 20, 22 and 24 of the furnace section 12, as well as the walls 74, 76, 80 and 82 of the separating section 14, are formed by a plurality of heat exchange tubes formed in a parallel, gas-tight manner to carry fluid to be heated, such as water or steam. It is also understood that a plurality of headers, of which only header 72 is shown, is disposed at both ends of each of the tube walls which, along with additional tubes and associated flow circuitry, would function to route the water through the water tubes of the reactor in a conventional manner.

An air distributor system including a plurality of air distributor nozzles (not shown) are mounted in corresponding openings formed in a tube panel 32 extending across the lower portion of the enclosure 12. The tube panel 32 is spaced from the floor 26 to define an air plenum 34, which is adapted to receive air from an external source (not shown) and to distribute the air through the nozzles into the furnace section 12.

The separating section 14 comprises a straight upper part 36, a hopper-like lower part 38 and a return duct 40. The separated particulate material passes from the separating section 14 through the return duct 40 into the heat exchange chamber 16. The heat exchange chamber 16 is made cost-effectively of metal plates covered by a relatively thick layer of insulation to prevent both erosion and heat loss from the chamber. Thus, the outer walls of the chamber 16 are not cooled. Naturally, the interior of the heat exchange chamber 16 comprises heat exchange surfaces (not shown) to recover heat from the recirculating particulate material into a fluid, such as water or steam, flowing through the interior of the heat exchange surfaces in the heat exchange chamber 16.

From the heat exchange chamber 16, the recirculating material is conducted, via a conduit 44, back to the furnace section 12 of the combustion system 10. Into the conduit 44 may be connected a fuel feeder 46, by which particulate material containing fuel may be introduced into the furnace section 12. Additional feeders 48 for fuel, as well as for inert bed material, a sulfur adsorbing agent, etc., may be located in the lower portion of the furnace section 12. Secondary air is introduced into the furnace section 12 by inlets 50.

A plurality of vertically extending steel support columns 52 extends from the ground 54 to a plurality of spaced horizontally extending beams 56. A plurality of hanger rods 58 extends downwardly from the beams 56 for supporting the furnace section 12 and the separating section 14.

According to the present invention, the heat exchange chamber 16 is supported by a plurality of short hanger rods 60 and 62, which are supported by hot water or steam tubes. In the embodiment shown in FIGS. 1 and 2, the hanger rods 60 are supported by the horizontal inlet header 72, which feeds hot water or steam to a planar wall 74 of the separating section 14. As seen in FIG. 2, even if the return duct 40 is downwardly tapered, the wall 74 maintains its full width all the way down to the header 72, allowing the hanger rods 60 to be connected on both sides of the return duct 40.

In the embodiment of FIGS. 1 and 2, it is possible to fix the hanger rods directly to the header 72 of the tubes of wall 74 because the return duct of the cyclone separator of the separating section 14 is located non-symmetrically, as a continuation of the wall 74. On the opposite, "outboard" side, the corresponding sidewall 76 of the separating section 14 does not extend down as low as on the "inboard" side, and thus, a different supporting system has to be used. If a rigid connecting rod extended all the way from the heat exchange chamber 16 to the upper part 36 of the cyclone separator of separating section 14, the relative thermal motions between the inboard and outboard sides would be large, and a special arrangement would be required to compensate for the difference.

According to a further embodiment of the present invention, when a heat exchange chamber 16 is to be supported by the upper part of the cyclone separator of separating section 14, vertical sections 68 of water or steam supply lines 66 are used as a part of the supporting system. The main function of the lines 66 is to supply water or steam to the tube walls of the separating section 14 or some other part of the boiler system of the combustion system 10. In the embodiment shown in FIGS. 1 and 2, the lower part of the vertical section 68 of the supply line 66 is connected to the heat exchange section 16 by a short hanger rod 62. Correspondingly, the upper part of the vertical section 68 of the supply line 66 is connected to the upper part of the cyclone separator 14 by a short hanger rod 64.

Because the thermal expansion of the hanger means at the "inboard" and "outboard" sides of the heat exchange chamber 16 can, according to the disclosed constructions, be made very much alike, no special arrangements are needed to compensate for their difference. Also, the thermal expansion of the hanger means is close to that of the return duct 40 and the lower part 38 of the separating section 14, and thus, a relatively short baffle 70 suffices to compensate for their relative thermal motions.

The suspension system of the heat exchange chamber 16 closely follows the thermal motion of the rest of the top-supported fluidized bed reactor system 10.

Therefore, the connection between the heat exchange chamber 16 and the lower part of the furnace section 12 also can be made simply, by using a mainly slant tube 44, which includes a vertical portion with a short baffle 78. The disclosed construction is compact in the sense that the heat exchange chamber 16 is located close to the separating section 14 and the furnace section 12. However, the heat exchange chamber 16 does not take up any space near the lower part of the furnace section 12 or near the ground 54. Therefore, a lot of room remains to arrange other possible conduits and reservoirs near the lower part of the furnace section 12.

Figure 3:
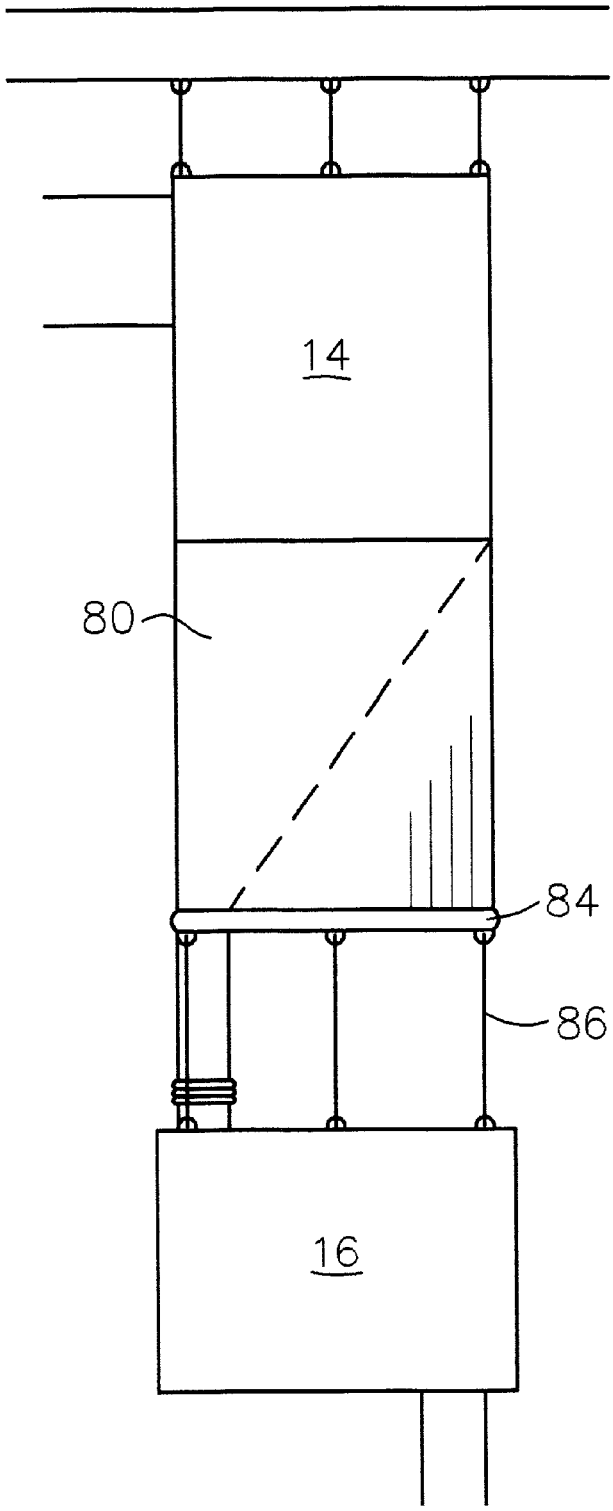
FIG. 3 is a schematic elevational view of a second embodiment of the present invention.

FIG. 3 schematically shows the suspension system of a heat exchange chamber 16 according to another embodiment of the present invention. In fact, FIG. 3 shows a modification of a portion of FIG. 1, where hot steam or water is fed to the wall tubes of sidewall 80, and of sidewall 82 (which is not shown in this figure), of the separating section 14 via horizontal inlet headers 84. The heat exchange chamber 16 is suspended by rigid hanger rods 86 fixed to the inlet headers 84. FIG. 3 shows three hanger rods, but naturally, their number can vary in practical applications. One can also combine the types of suspension means shown in FIGS. 1 and 3, if required. It is also possible to extend a portion, e.g., every fifth tube, of the wall tubes from wall 76 in FIG. 1 down, e.g., to the level of the inlet header 84, and to utilize these tubes as a part of the suspension system of the heat exchange chamber 16.

Figure 4:
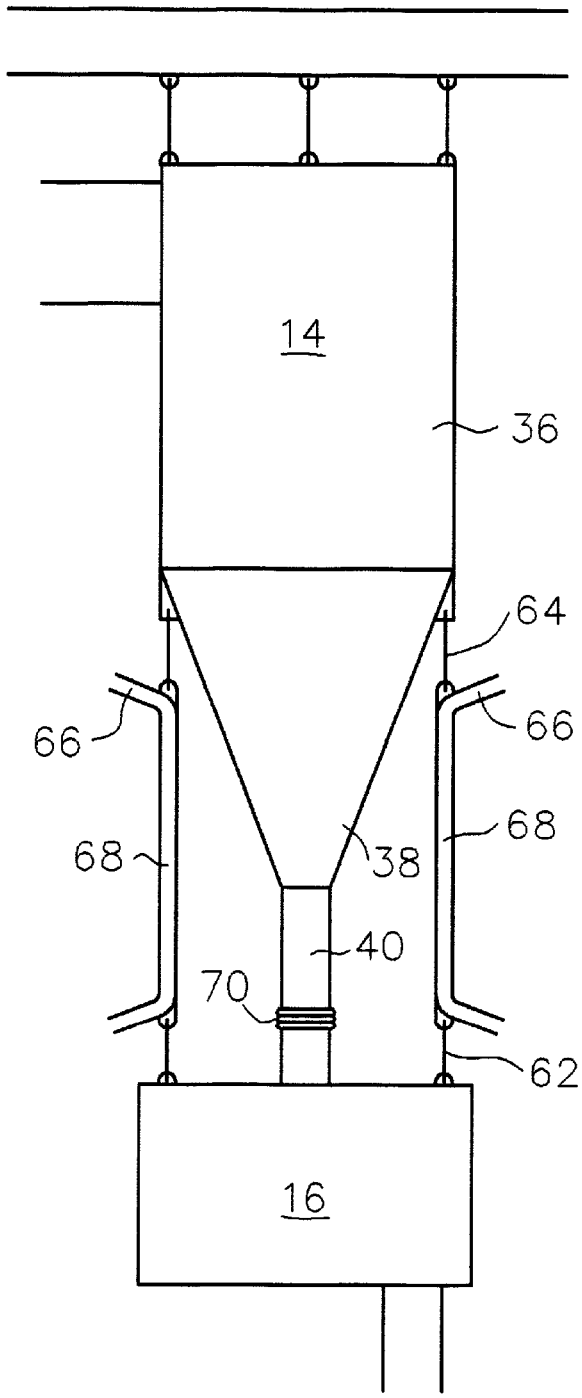
FIG. 4 is a schematic elevational view of a third embodiment of the present invention.

FIG. 4 schematically shows a suspension system of a heat exchange chamber 16 in connection with a symmetrical separating section 14, according to a third embodiment of the present invention. In FIG. 4, all the hanger means of the heat exchange chamber 16 include vertical sections 68 of hot water or steam tubes 66. These vertical sections 68 are connected to the heat exchange chamber 16 and to the lower edge of the cylindrical upper part 36 of the separating section 14 by short rigid hanger rods 62 and 64, respectively. Thus, the thermal expansion of the hanger means nearly corresponds to that of the lower part 38 of the separating section 14 and the return duct 40, and a short baffle 70 suffices to compensate for their relative thermal motions.

While the invention has been herein described by way of examples in connection with what are at present considered to be the most preferred embodiments, it is to be understood that the invention is not limited to the disclosed embodiments, but is intended to cover various combinations or modifications of their features and several other applications included within the scope of the invention as defined in the appended claims.

What is claimed is:

1. A top-supported circulating fluidized bed boiler system comprising:

a furnace, having sidewalls of a tube wall construction, for combusting fuel and producing combustion products;

a particle separator, connected to said furnace, for separating particles from the combustion products from said furnace;

an external heat exchange chamber connected to said particle separator for removing heat from the combustion products;

a return duct, connected to said heat exchange chamber, for returning particles separated by said separator to said furnace;

a rigid support construction for supporting elements of said system; and suspension means, comprising at least one of steam tubes and water tubes, for suspending said heat exchange chamber from said rigid support construction.

2. A system according to claim 1, wherein said steam tubes or water tubes are in operation at a temperature of about 300 to about 550° C.

3. A system according to claim 1, wherein said external heat exchange chamber includes external walls which are not cooled.

4. A system according to claim 1, wherein said rigid support construction is located above said boiler system for supporting elements of said boiler system.

5. A system according to claim 1, wherein more than about 60% of the length of said suspension means comprises at least one of steam tubes and water tubes.

6. A system according to claim 1, wherein said particle separator comprises a straight upper portion having sidewalls of a tube wall construction and a conical lower portion.

7. A system according to claim 6, further comprising hanger means for suspending said heat exchange chamber from the upper portion of said particle separator.

8. A system according to claim 7, wherein said hanger means comprises at least one of steam tubes and water tubes.

9. A system according to claim 7, wherein said hanger means comprises at least one of steam tubes and water tubes extending downwards from the upper portion of said particle separator.

10. A system according to claim 7, wherein said hanger means comprises at least one of steam lines and water supply lines.

11. A system according to claim 7, wherein at least about 50% of the length of said hanger means comprises at least one of steam tubes and water tubes.

12. A system according to claim 7, further comprising a header which feeds at least one of hot water and steam to the tube walls of said particle separator.

13. A system according to claim 12, wherein at least a portion of said hanger means is connected to said header.

14. A system according to claim 1, wherein said particle separator comprises sidewalls having a tube wall construction, a straight upper section and a non-symmetrical lower section.

15. A system according to claim 14, wherein said suspension means comprises at least one of steam lines and water supply lines.

16. A system according to claim 15, further comprising hanger rods for connecting said suspension means to the upper section of said particle separator.

17. A system according to claim 14, wherein a portion of said suspension means comprises at least one of steam lines and water supply lines.

18. A system according to claim 17, further comprising hanger rods for connecting the portion of said suspension means to the upper section of said particle separator.

19. A system according to claim 18, wherein a portion of said suspension means comprises wall tubes of the lower section of said particle separator.

* * * * *